US008313111B2

(12) United States Patent
Ahuja et al.

(10) Patent No.: US 8,313,111 B2
(45) Date of Patent: Nov. 20, 2012

(54) SYSTEMS AND METHODS FOR WEIGHT TRANSFER IN A VEHICLE

(75) Inventors: Munishwar Ahuja, Bangalore (IN); Nikhil Subhashchandra Tambe, Bangalore (IN); Bret Worden, Union City, PA (US); Mandyam Sridhar, Bangalore (IN)

(73) Assignee: General Electric Company, Niskayuna, NY (US)

( * ) Notice: Subject to any disclaimer, the term of this patent is extended or adjusted under 35 U.S.C. 154(b) by 216 days.

(21) Appl. No.: 12/869,462

(22) Filed: Aug. 26, 2010

(65) Prior Publication Data

US 2012/0049478 A1 Mar. 1, 2012

(51) Int. Cl.
*B60G 17/033* (2006.01)
*B60G 17/016* (2006.01)

(52) U.S. Cl. ..... 280/6.159; 280/124.151; 280/124.158

(58) Field of Classification Search ..... 180/209, 180/41, 22; 280/86.5, 5.514, 5.52, 6.15, 280/6.159, 6.157, 124.101, 124.151, 124.158
See application file for complete search history.

(56) References Cited

U.S. PATENT DOCUMENTS

| | | | | |
|---|---|---|---|---|
| 1,585,833 | A * | 5/1926 | Down | 303/22.8 |
| 3,166,340 | A * | 1/1965 | Rusconi | 280/104 |
| 3,850,437 | A * | 11/1974 | Owen | 280/6.157 |
| 3,941,061 | A | 3/1976 | Schindehutte et al. | |
| 4,088,080 | A | 5/1978 | Jackson | |
| 4,793,047 | A | 12/1988 | Curtis et al. | |
| 6,036,206 | A * | 3/2000 | Bastin et al. | 280/124.1 |
| 6,997,464 | B2 * | 2/2006 | Yakimishyn | 280/6.159 |
| 7,255,047 | B1 | 8/2007 | Coslovi et al. | |
| 8,002,065 | B2 | 8/2011 | Glavinic et al. | |
| 2003/0155164 | A1 * | 8/2003 | Mantini et al. | 180/209 |
| 2009/0184480 | A1 * | 7/2009 | Larsson et al. | 280/5.503 |

FOREIGN PATENT DOCUMENTS

| | | | |
|---|---|---|---|
| DE | 19802489 | A1 | 3/1999 |
| EP | 0440571 | A1 | 8/1991 |
| EP | 1571014 | A2 | 9/2005 |
| EP | 2138333 | A1 | 12/2009 |
| GB | 580065 | A | 8/1946 |
| GB | 1509433 | | 5/1978 |
| GB | 2238990 | A | 6/1991 |

OTHER PUBLICATIONS

Search Report and Written Opinion from corresponding PCT Application No. PCT/US2011/049033 dated Nov. 29, 2011.

* cited by examiner

*Primary Examiner* — Drew Brown
(74) *Attorney, Agent, or Firm* — Joseph J. Christian

(57) ABSTRACT

Systems and methods for weight transfer in a vehicle are provided. One system includes a plurality of springs and a plurality of movable spring seats configured to adjust a length of the plurality of springs. Additionally, a pneumatic actuator is provided that is connected to the plurality of movable springs and configured to move the movable spring seats to adjust the length of the plurality of springs. Further, a controller is provided that is coupled to the pneumatic actuator to control the pneumatic actuator to adjust the length of the plurality of springs.

24 Claims, 7 Drawing Sheets

SYSTEMS AND METHODS FOR WEIGHT TRANSFER IN A VEHICLE

BACKGROUND OF THE INVENTION

Vehicles, such as diesel-electric locomotives, may be configured with truck assemblies including two trucks per assembly, and three axles per truck, for example. The three axles may include at least one powered axle and at least one non-powered axle. The axles may be mounted to the truck via lift mechanisms, such as suspension assemblies including one or more springs, for adjusting a distribution of locomotive weight (including a locomotive body weight and a locomotive truck weight) between the axles.

As the vehicle travels along the rails, the amount of load on each of the axles of the truck can vary, with each axle also having a maximum load weight. In certain conditions, such as during inclement weather, proper traction with the track may be lost, thereby resulting in one or more wheels slipping. Accordingly, the tractive effort for these vehicles may be less than optimized. For example, the tractive effort may be affected on trains, particularly for heavy trains or hauls, during start-up, on inclines, and during adverse rail conditions, such as caused by inclement weather or other environmental conditions.

In known rail vehicle systems, the springs of the suspension systems for the trucks are preloaded. For example, each of the springs is preloaded based on a normal amount of weight to be supported by the suspension system for the axles. As a result, under certain conditions, the preloaded springs may not provide the sufficient normal force to maintain proper contact between the wheels of the truck and the track, especially during inclement or adverse rail conditions.

BRIEF DESCRIPTION OF THE INVENTION

In accordance with various embodiments, systems and methods for weight transfer in a vehicle are provided. One embodiment includes a plurality of springs and a plurality of movable spring seats configured to adjust a length of the plurality of springs. Additionally, a pneumatic actuator is provided that is connected to the plurality of movable springs and configured to move the movable spring seats to adjust the length of the plurality of springs. Further, a controller is provided that is coupled to the pneumatic actuator to control the pneumatic actuator to adjust the length of the plurality of springs.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
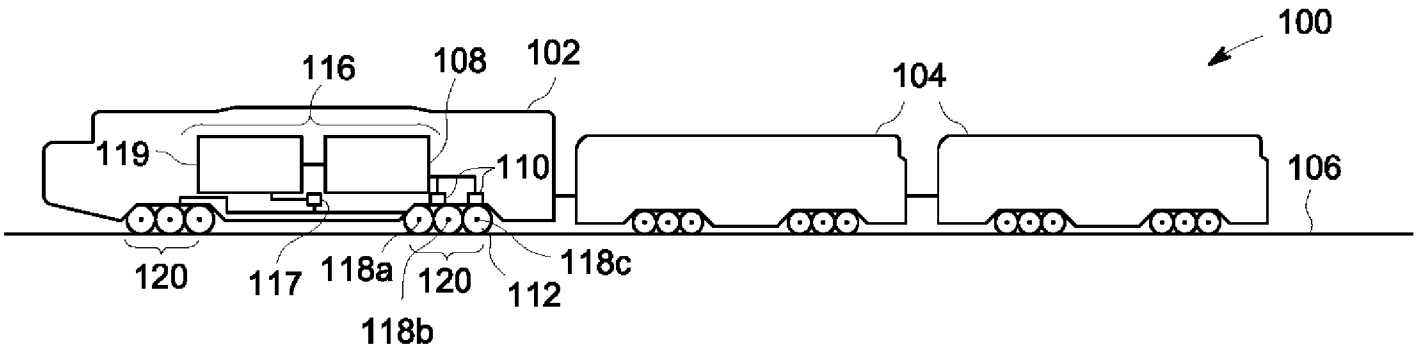
FIG. 1 is a diagram of a vehicle formed in accordance with one embodiment.

To the extent that the figures illustrate diagrams of the functional blocks of various embodiments, the functional blocks are not necessarily indicative of the division between components. Thus, for example, one or more of the functional blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with powered rail vehicle systems having locomotives with trailing passenger or cargo cars, the embodiments described herein are not limited to trains. In particular, one or more embodiments may be implemented in connection with different types of vehicles including wheeled vehicle, other rail vehicles, and track vehicles.

Example embodiments of one or more apparatus and methods for changing the load of the axles to redistribute the load on the axles of a truck in a vehicle are provided. As described below, one or more of these embodiments provide dynamic weight transfer among the axles, for example, to redistribute the load to provide more load on the powered axles. By practicing the various embodiments, and at least one technical effect is increased traction on the powered axles, which may facilitate the tractive effort during certain traction limited modes of operation. Moreover, by practicing the various embodiments, less traction motors may be used to generate the same amount of tractive force or effort. For example, on a six axle truck, traction motors may be provided on only four of the axles instead of all six axles. Additionally, by practicing the various embodiments, improved braking may be provided.

FIG. 1 is a diagram of a powered rail vehicle 100 formed in accordance with one embodiment, illustrated as a locomotive system. While one embodiment of the presently described subject matter is set forth in terms of a powered rail vehicle, alternatively the subject matter may be used with another type of vehicle as described herein and noted above. The rail vehicle 100 includes a lead powered unit 102 coupled with several trailing units 104 that travel along one or more rails 106. In one embodiment, the lead powered unit 102 is a locomotive disposed at the front end of the rail vehicle 100 and the trailing units 104 are cargo cars for carrying passengers and/or other cargo. The lead powered unit 102 includes an engine system, for example, a diesel engine system 116. The diesel engine system 116 is coupled to a plurality of traction motors 110 that provide the tractive effort to propel the rail vehicle 100. For example, the diesel engine system 116 includes a diesel engine 108 that powers traction motors 110 coupled with wheels 112 of the rail vehicle 100. The diesel engine 108 may rotate a shaft that is coupled with an alternator or generator (not shown). The alternator or generator creates electric current based on rotation of the shaft. The electric current is supplied to the traction motors 110, which turn the wheels 112 and propel the rail vehicle 100. It should be noted that for simplicity and ease of illustration, the traction motors 110 are only shown in connection with one set of wheels 112. However, traction motors 110 may be provided in connection with other wheels 112 or sets of wheels 112 as described herein.

Figure 2:
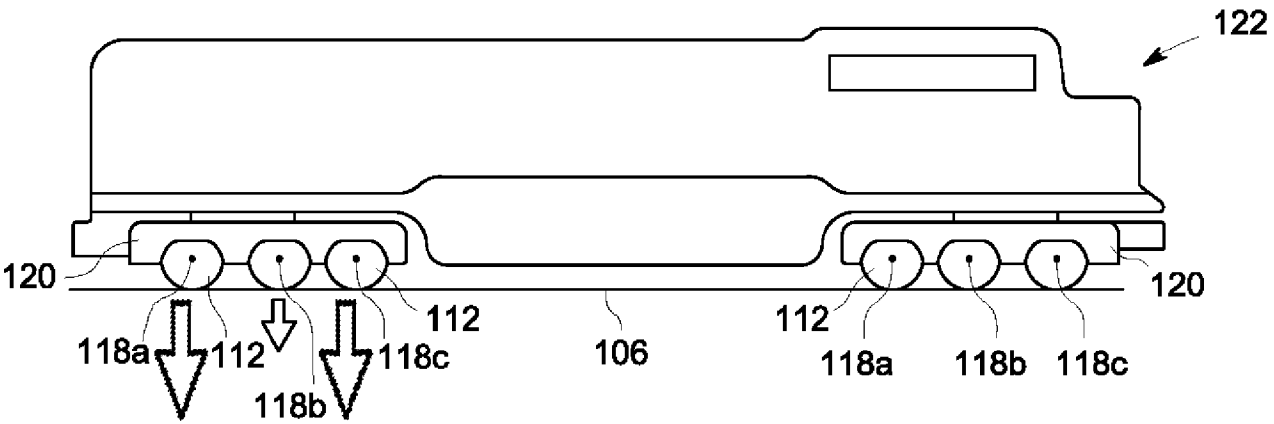
FIG. 2 is a side view of a vehicle having trucks with variable spring preloaded suspensions in accordance with various embodiments.
Figure 3:
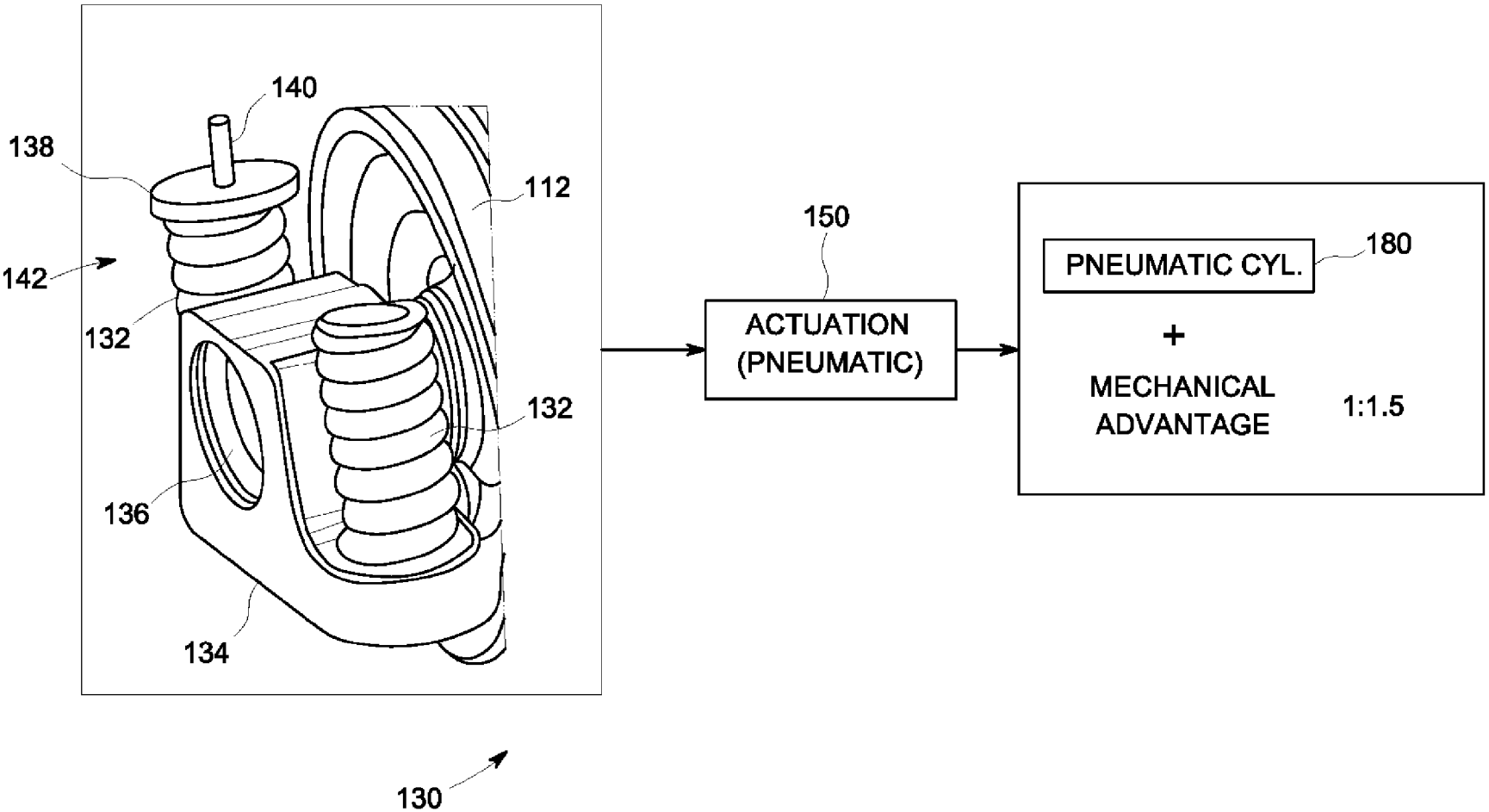
FIG. 3 is a diagram of a spring preloading mechanism with actuation in accordance with various embodiments.

The rail vehicle 100 includes a controller, such as a control module 114 that is communicatively coupled with the traction motors 110 and/or an actuator 117 for controlling the load on springs 132 of a suspension system 142 (both shown in FIG. 3). For example, the control module 114 may be coupled with the traction motors 110 and/or the actuator 117 by one or more wired and/or wireless connections. The control module 114 operates in some embodiments to control and redistribute the load supported by the each of the wheels 112, and more particularly, each axle 118. In various embodiments, dynamic load distribution may be independently provided to each of the axles 118. For example, each of the units 102 and 104 may include two sets of wheels 112 corresponding to two trucks 120 (shown more clearly in FIG. 2). As illustrated, each truck 120 includes three axles 118, with each having two wheels 112. In some embodiments, the outer axles 118*a* and 118*c* are each powered by a traction motor 110, with the inner axle 118*b* not powered by a traction motor 110. Accordingly, for a particular unit 102 or 104, traction motors 110 are provided in connection with a total of four axles 118 instead of all six axles 118. It should be noted that the number of traction motors 110 and which axles 118 are connected to the traction motor 110 may be modified such that different configurations of tractive power may be provided.

The control module 114 may include a processor, such as a computer processor, controller, microcontroller, or other type of logic device, that operates based on sets of instructions stored on a tangible and non-transitory computer readable storage medium. The computer readable storage medium may be an electrically erasable programmable read only memory (EEPROM), simple read only memory (ROM), programmable read only memory (PROM), erasable programmable read only memory (EPROM), FLASH memory, a hard drive, or other type of computer memory.

Thus, as illustrated by the locomotive 122 shown in FIG. 2, weight transfer or redistribution may be provided, such as when the wheels 112 are slipping relative to the rails (e.g., track) 106. In accordance with various embodiments, weight redistribution is provided, such that weight from the inner or middle axle 118*b* is redistributed to the outer axles 118*a* and 118*c*, illustrated by the larger arrows corresponding to the outer axles 118*a* and 118*c* and the smaller arrow corresponding to the inner axle 118, which represents a change in the weight or load on each of the axles 118*a-c*. The increased weight on the outer axles 118*a* and 118*c* results in increased traction of the wheels 112 of the axles 118*a* and 118*c* with the rails (e.g., track) 106, which reduces the amount of wheel slip, such as during traction limited modes of operation. Thus, the control module 114 may provide dynamic weight redistribution among the axles 118*a-c*. It should be noted that weight redistribution may be provided in connection with any unit of the rail vehicle system.

The weight redistribution in some embodiments includes a transfer of the weight from the inner axle 118*b* equally to the outer axles 118*a* and 118*c*. The weight redistribution is provided by changing the preload of springs in connection with one or more of the axles 118*a-c*. For example, in some embodiments, four springs are provided per axle 118*a-c*. However, the redistribution of weight is achieved by changing the preload of some, but not all of the springs.

Various embodiments redistribute weight among the axles 118*a-c* by changing a spring length, for example, a working spring length. Thus, a preload on the spring is changed such that variable spring displacement is provided. For example, in one embodiment as illustrated in FIG. 3, a variable spring preload arrangement 130 is illustrated forming part of a suspension system 142. It should be noted that like numbers represent like parts in the Figures. The variable spring preload arrangement 130 includes a mechanism for changing a preload of one or more springs 132 of the suspension system 142 of the truck 120 (shown in FIG. 2), a portion of which is shown in FIG. 3. An axle box 134 (which also may be referred to as a journal box) is provided having an opening 136 therethrough for receiving an axle, such as the axle 118*a-c* of the locomotive 122 (both shown in FIG. 2) extending also through the wheel 112. In the illustrated embodiment, two springs 132 are provided in connection with each axle side.

In one embodiment, as shown in FIG. 3, the mechanism for changing the preload of the springs 132 and thereby adjusting the working length of the springs 132 is a spring seat 138. It should be noted that although the spring seat 138 is shown at a top end of the springs 132, the spring seat 138 may be located on a bottom end of the springs 132. In the illustrated embodiment, the bottom or lower end of the spring may be supported on the axle box 134 using, for example, a spring cap or other suitable means. Thus, the variable spring preload arrangement 130 in some embodiments includes a mechanism wherein a top end of the springs 132 is movable to provide the adjustable preloading and the bottom end of the springs 132 is fixed against the axle box 134.

In FIG. 3, one of the springs 132 (the right side spring 132) is shown without the spring seat 138 attached. The spring seat 138 may include a coupling end 140 to allow controllable actuation of the variable spring preload arrangement 130, such as by the control module 114 (shown in FIG. 1). The controllable actuation in various embodiments is provided using an pneumatic actuation system 150 as described in more detail below and which may form part of the actuator 117 (shown in FIG. 1). The pneumatic actuation system 150 may be implemented in different configurations and arrangements, as well as positioned at different locations of the truck. As one example, one or more pneumatic cylinders 180 may be provided with a rotating cam arrangement as described in more detail herein such that rotational movement is translated to linear movement of the spring seat 138. Moreover, a mechanical advantage may be provided using different configurations of the actuation mechanism, for example, using a lever as described in more detail herein. For example, in some embodiments, a mechanical advantage of 1:1.5 may be provided. However, it should be noted that different ratios of mechanical advantage may be provided depending on the configuration.

Thus, the preload and effective pre-compression of the springs 132 may be dynamically adjusted, which affects the working length of the springs 132 and the load on the axle 118. In some embodiments, the changing of the preloading of the springs 132 may be initiated based on a user input, for example, based on a user identifying a traction limited mode of operation (e.g., wheel slipping or upcoming rail incline or adverse rail condition). In other embodiments, the changing of the preloading of the springs 132 may be initiated automatically, for example, based on a sensed or detected traction limited mode of operation using one or more sensors. In these embodiments, upon detecting the traction limited mode of operation or an upcoming traction limited mode of operation, such as based on an identification of the traction limited mode of operation by the sensor, which is communicated to the control module 114, the control module 114 automatically changes the preloading of the springs 132. A notification of the automatic preloading change may be provided to an operator, such as via an audible and/or visual indicator.

Figure 4:
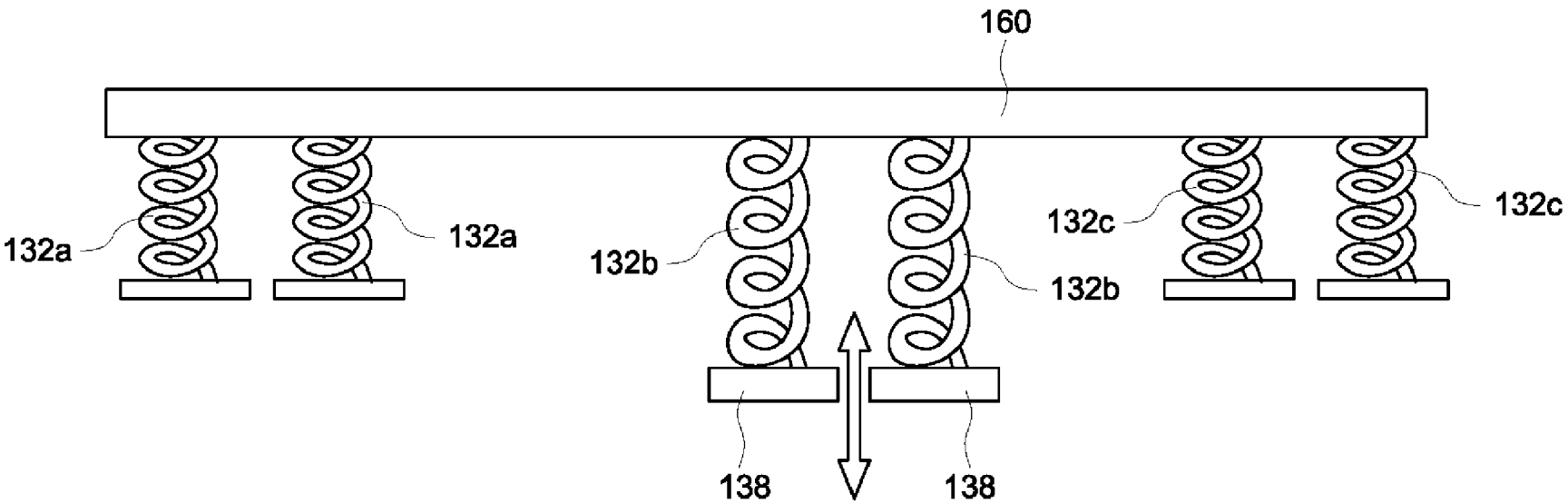
FIG. 4 is a schematic block diagram of a variable spring preload arrangement in accordance with one embodiment.
Figure 5:
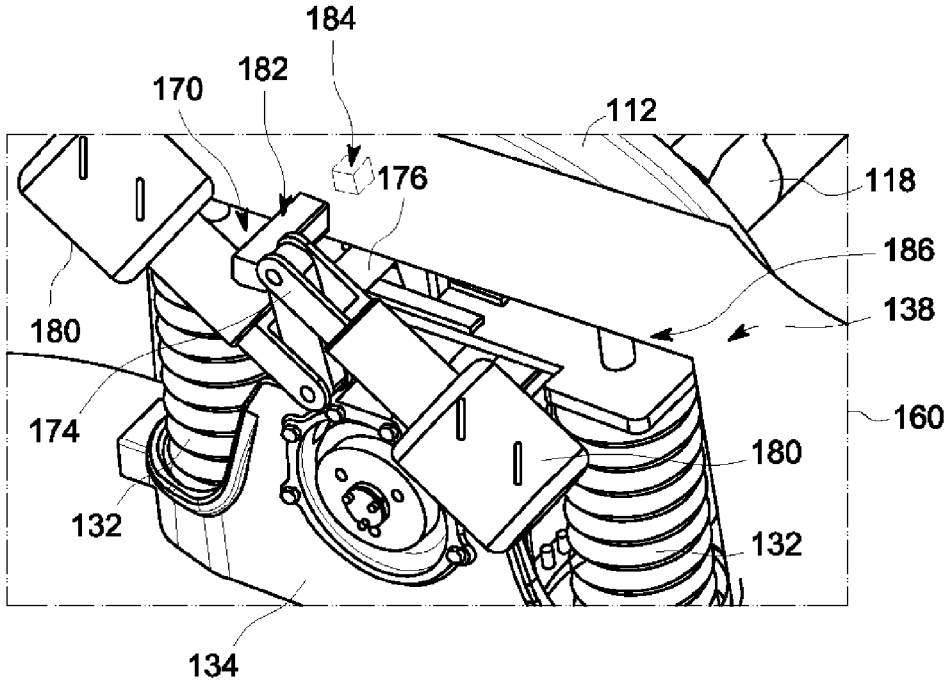
FIG. 5 is a perspective view of an actuator formed in accordance with one embodiment.
Figure 6:
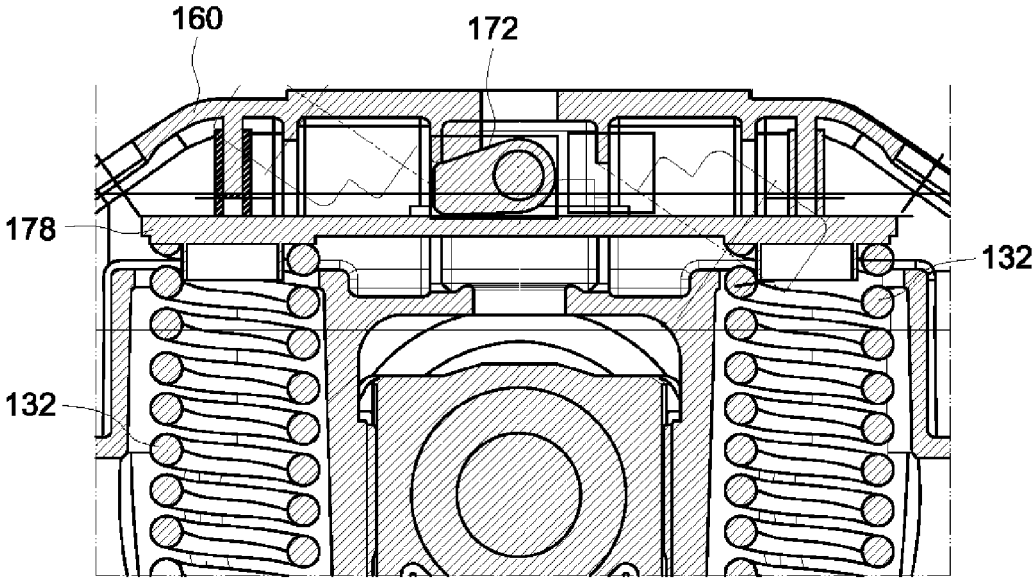
FIG. 6 is a cross-sectional view of an actuator formed in accordance with one embodiment.

In various embodiments, the control module 114 instructs the pneumatic actuation system 150 to change the preloading of the springs 132, for example, by operating the one or more pneumatic cylinders 180, which causes a linear translation of the spring seat 138. The translation of the spring seat 138 that changes the preloading and working length of the springs 132 redistributes the load among the axles 118 (shown in FIGS. 1 and 2). For example, the pneumatic actuation system 150 may cause the spring seats 138 to move vertically downward to compress the springs 132 to shorten the working length of the springs 132 or move vertically upward to lengthen the working length of the springs 132 as illustrated in FIG. 4. For example, if the spring seats 138 are moved vertically upward, the working length of the springs 132 is increased or lengthened, which reduces the preloading of the springs 132. The reduction in the preloading of the springs 132 causes a shift in the weight among the axels 118 (shown in FIGS. 1 and 2), namely to the other axles 118.

More particularly, referring to the example in FIG. 4, showing a portion of a truck frame 160, if the preloading of the springs 132 of the center axle 118*b* is reduced by lengthening the springs 132, the weight or load is transferred or redistributed from the center axle 118*b* to the outer axles 118*a* and 118*c* (the axles 118*a*, 118*b* and 118*c* are shown in FIGS. 1 and 2). The outer springs 132*a* and 132*c* correspond to the outer axles 118*a* and 118*c* and the inner springs 132*b* correspond to the inner axles 118*b*. The weight redistribution is equal when the change in spring preloading is the same. Accordingly, weight redistribution is provided by moving the spring seats 138 to change the preloading of the springs 132. It should be noted that in this embodiment, the spring seat 138 is illustrated at the bottom end of the springs 132. Also, in the illustrated embodiment, the spring seats 138 are shown on the springs 132*b* and not the other springs 132*a* and 132*b*. However, the spring seats 138 and consequently the control of the preloading may also be provided to the other springs 132*a* and/or 132*b* and at different locations or ends of the springs.

The spring seats 138 may be any suitable device for engaging and abutting an end of the springs 132 for translating the springs 132. For example, the spring seats 138 may be a washer or other end support for the springs 132, such as a support plate. Additionally, the springs 132 may be any type of spring, such as any spring suitable for a locomotive suspension.

In an initial state of preloading, such as during a normal operating mode when a traction limited mode of operation is not detected, all of the springs 132*a*, 132*b* and 132*c* are preloaded the same. Thus, all of the springs 132*a*, 132*b* and 132*c* have the same or about the same working length. As the working length of the center springs 132*b*, which is an effective length of the springs, is increased, the net preload on the inner axle 118*b* (center axle) changes and the load or weight is redistributed to the outer axles 118*a* and 118*c*.

As an example, if the rated load of each of the three axles 118*a*, 118*b* and 118*c* is 70,000 pounds (also referred to as 70,000 pounds-force (lbf)), the axles 118*a*, 118*b* and 118*c* may be precompressed to have the same preloading. In this normal operating state, the working length of the springs 132*a*, 132*b* and 132*c* may be about 20.5 inches. In such an embodiment, the limits of the springs 132*a*, 132*b* and 132*c* defined by the solid length and the free length of the springs 132*a*, 132*b* and 132*c* may be about 17 inches to about 25 inches. By changing the compression of one or more of the springs, such as the inner springs 132*b* (also referred to as the center springs), the load on all of the axles 118*a*, 118*b* and 118*c* is redistributed. For example, if the length of the inner springs 132*b* is increased by about 1.5 inches, approximately 40,000 lbf is transferred about equally from the inner axle 118*b* (also referred to as the center axle) to the outer axles 118*a* and 118*c*. Thus, the inner axle 118*b* supports a load of 30,000 lbf, while each of the outer axles 118*a* and 118*c*, to which the extra load of 40,000 lbf has been redistributed about equally, now supports 90,000 lbf each, thereby increasing the traction of the wheels 112 (shown in FIGS. 1 and 2) of the outer axles 118*a* and 118*c*.

The pneumatic actuation system 150 may be implemented in different configurations and arrangements. In some embodiments, the pneumatic actuation system 150 converts rotational movement into translational or linear movement to change the preloading of springs to redistribute the load among the axles 118. It should be noted that other actuation methods may be used. For example, the actuator may be one or more of a linear actuator, an electromechanical actuator, a hydraulic actuator, an electric actuator, an electro-magnetic actuator, a high pressure gas actuator, a mechanical actuator, and the like, that provides spring seat displacement.

In general, the various embodiments provide spring seat displacement using the pneumatic actuation system 150 (shown in FIG. 3). For example, the pneumatic actuation system 150 may cause movement, such as vertical movement of the spring seat 138, which may be located at a top or bottom of the springs 132. As illustrated in FIGS. 5 through 8, the movable end of the spring 132 is the upper end with the lower end of the spring 132 being fixed, for example, supported by the axle box 134. For example, the pneumatic actuation system 150 may include an actuator 170 that operates using an upper compression mechanism to change the length of the springs 132. In this embodiment, the actuator 170 is shown mounted to the truck frame 160. However, in other embodiments, the actuator 170 may be mounted to other portions of the locomotive or locations of the truck frame 160. In various embodiments, the actuator 170 is only mounted to one of the axles 118, in particular the inner axles 118*b* (shown in FIGS. 1 and 2). However, the actuator 170 may be provided on different axles, for example, each of the outer axles 118*a* and 118*c* may include the actuator 170 and the inner axle 118*b* does not include an actuator 170.

In various embodiments, the actuator 170 includes a rotating cam arrangement having a cam 172 (shown more clearly in FIGS. 6 and 8) coupled to a lever 174 via a camshaft 176. For example, the camshaft 176 may be a rod extending from or through the cam 172 to the lever 174. The cam 172 and lever 174 are in substantially parallel planes with the camshaft 176 extending transverse or perpendicular therebetween. The camshaft 176 in the illustrated embodiment extends through an opening in the truck frame 160 to maintain the position of and support the camshaft 176. The camshaft 176 is coupled to one end of the cam 172 and to a center or middle region of the lever 174.

Thus, movement of the lever 174, and more particularly rotation of the lever 174, is translated to and causes rotation of the cam 172. The rotation of the cam 172 causes translational or linear movement of the spring seat 138, which in this embodiment, is provided as a top plate 178 (e.g., a metal planar plate). The translational or linear movement compresses or releases compression of the springs 132. It should be noted that the top plate 178 acts as the spring seat for two springs 132 in this embodiment. However, separate top plates 178 may be provided for each of the springs 132.

The lever 174 is actuated pneumatically, which in the illustrated embodiment includes a pneumatic cylinder 180 connected by a pin-slot mechanism to opposite ends of the lever 174. For example, the pneumatic cylinders 180 may be connected to each end of the lever 174 using. If the arrangement pivots, then the piston rod of the pneumatic cylinder 180 includes a flexible member (not shown) and is connected using, for example, a pin or other suitable fastener. The pneumatic cylinders 180 operate using the principles of pneumatics and may be any type of pneumatically operated cylinders. The pneumatic cylinders 180 (sometimes known as air cylinders) may be any mechanical devices that produce force, in combination with movement, and are powered by compressed gas (e.g., air). In some embodiments, the pneumatic cylinders 180 are pneumatic braking cylinders also used in connection with brakes to stop the locomotive (shown in FIG. 2).

The pneumatic cylinders 180 are configured such that actuation of the pneumatic cylinders 180 causes rotation of the lever 174, which may be either clockwise or counterclockwise rotation. A stopper 182 is also provided on one end of the lever 174 to limit the rotational movement of the lever 174 in one direction, thereby limiting rotational movement of the cam 172. A stopper 184 is also provided on one end of the cam 172 to limit rotational movement of the lever 174, in another direction, for example, opposite the direction of the movement that is limited by the stopper 182. The stopper 184 is located on an end of the cam 172 opposite the end coupled to the camshaft 176. Thus, the stoppers 182 and 184 define the extent of rotation of the cam 172, which defines the amount of movement of the top plate 178, thereby defining the amount the springs 132 may be compressed.

A guide 186, illustrated as a pin extending through the top plate 178, is provided to allow translational or linear movement of the top plate 178, while reducing or limiting out of plane movement. For example, during operation, the guide 186 guides the movement of the top plate 178.

It should be noted that the length, size and/or shape of the cam 172 and lever 174 may be varied. For example, the dimensions of the cam 172 and lever 174 may be selected based on an amount of mechanical advantage and/or an amount of compression of the springs 132 desired or required.

Figure 7:
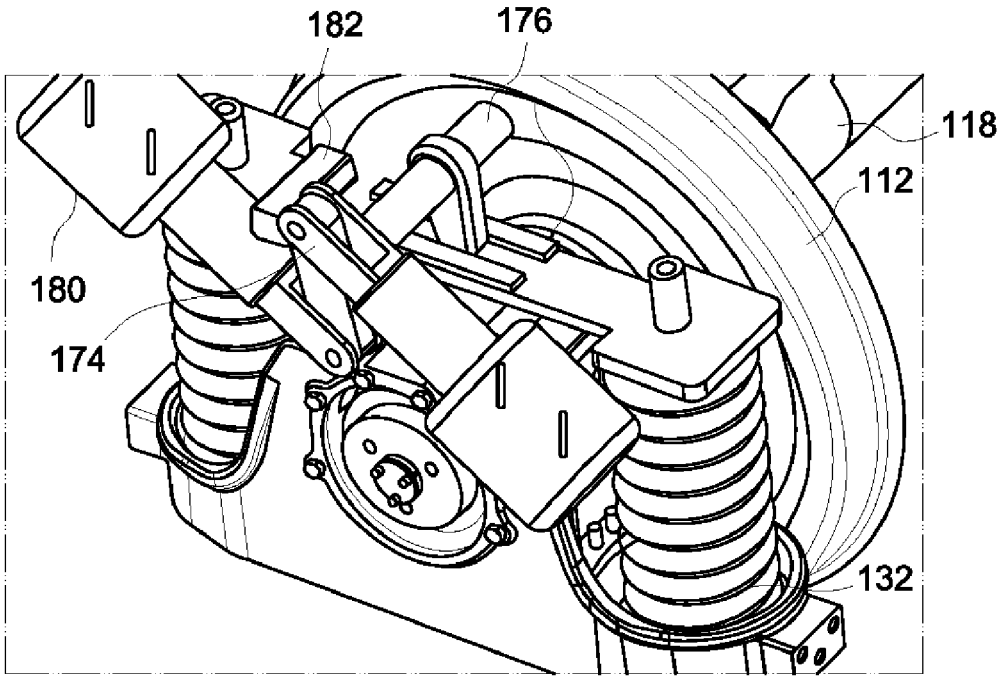
FIG. 7 is a perspective view of the actuator of FIGS. 5 and 6 in a normal operating state.
Figure 8:
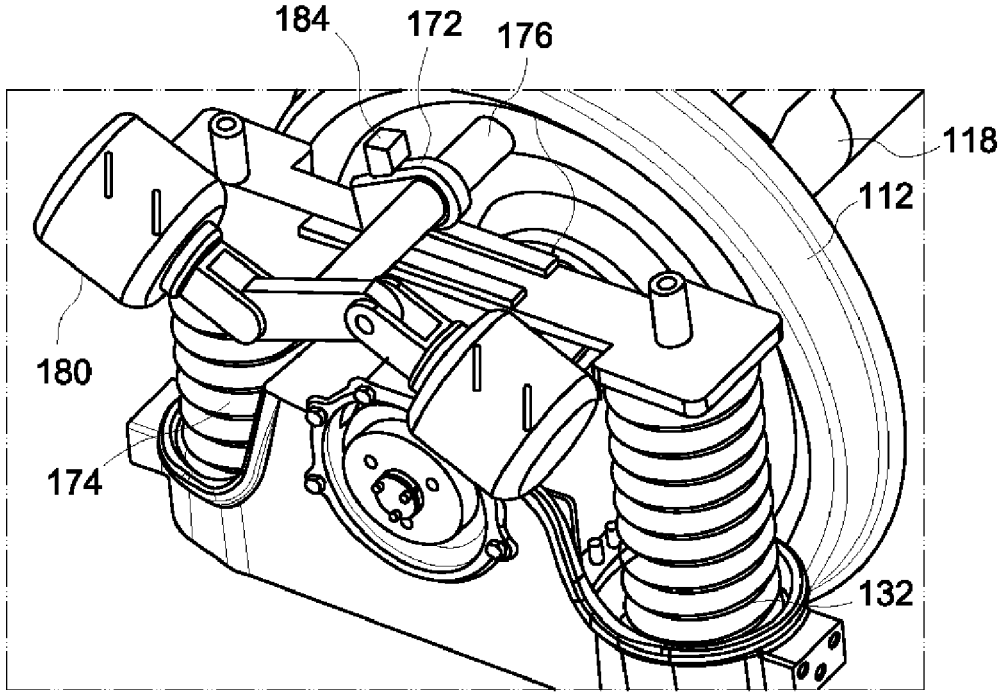
FIG. 8 is a perspective view of the actuator of FIGS. 5 and 6 is a weight redistribution state.

Thus, as illustrated in FIGS. 7 and 8, as the cam 172 is rotated by the rotation of the lever 174, which is actuated by the pneumatic cylinders 180, the top plate 178 is moved. For example, as the cam 172 rotates, the rotational movement is translated to linear movement of the top plate 178, such that the top plate 178 is moved up or down (as viewed in FIGS. 7 and 8). The movement of the top plate 178 causes the springs 132 to compress or decompress. In FIGS. 7 and 8, the springs 132 are shown in a normal operating state and a weight redistribution state, respectively. In particular, in FIG. 7, the cam 172 is in a 90 degree position with a flat end of the cam 172 engaging the top plate 178. In this normal operating state, the springs 132 are compressed by the top plate 178 such that all of the springs 132 of the locomotive suspension have the same compression, namely, the same preloading. For example, the springs 132 are compressed a same amount as other precompressed springs that do not include variable preloading. In some embodiments, the illustrated springs 132 having the variable compression are provided in connection with the suspension for the center axle 118*b* (shown in FIGS. 1 and 2), which are compressed a same amount as precompressed springs provided in connection with the suspension for the other axles of the locomotive truck, namely the outer axles 118*a* and 118*c* (shown in FIGS. 1 and 2). Thus, in the normal operating state, the load is distributed equally on each of the axles 118*a-c*.

The cam 172 is then rotated, for example, in a counterclockwise direction (e.g., ninety degrees to a zero degree position) to the weight redistribution state as described herein. In this state, the top plate 178 is moved linearly upward such that the preloading is decreased as the compression on the springs 132 is decreased, which increases the working length of the springs 132. The amount of rotation may be limited, for example, by the stopper 184. In this weight redistribution state, because the length of the springs 132 has increased, some of the load on the springs 132 is redistributed to other springs as described herein. Accordingly, weight from the load is redistributed to other axles to provide dynamic weight management.

The cam 172 may then be rotated, for example, in a clockwise direction to return to the normal operating state. The amount of rotation in this direction may be limited, for example, by the stopper 182. It should be noted that the stoppers 182 and 184 are provided to limit the rotation of the cam 172 between two maximum rotation points. However, the cam 172 can be rotated to angle between these points to obtain a desired or required amount of weight transfer, and thereby traction.

Figure 9:
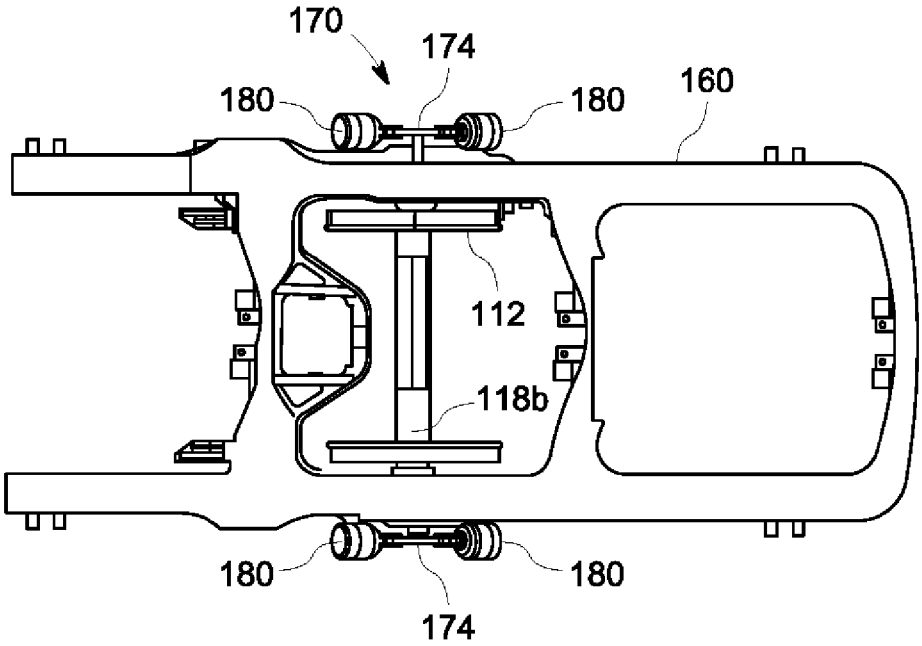
FIG. 9 is a top plan view of a vehicle having an actuator formed in accordance with various embodiments.
Figure 10:
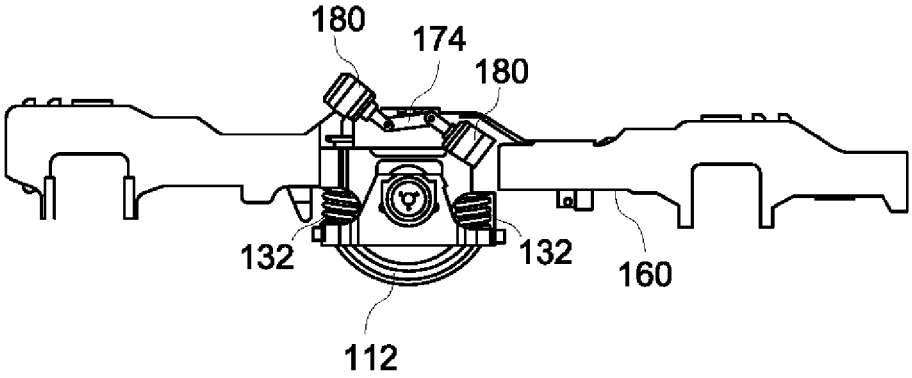
FIG. 10 is a side elevation view of the vehicle of FIG. 9.
Figure 11:
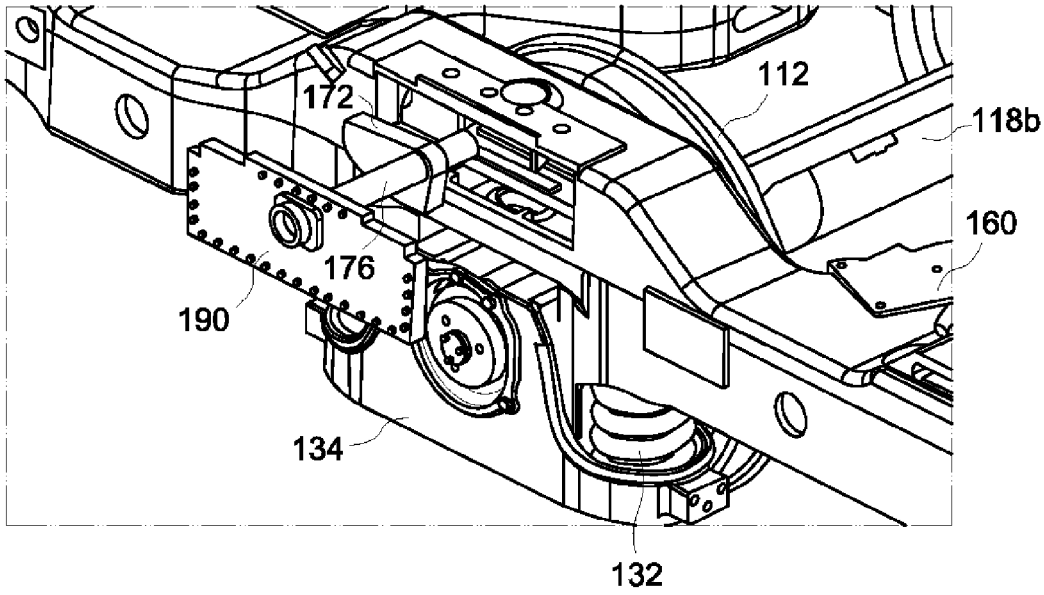
FIG. 11 is a perspective view of a mounting arrangement for an actuator in accordance with various embodiments.

In various embodiments, the variable spring management is provided in connection with a center axle 118*b* as illustrated in FIGS. 9 through 11. As shown therein, the actuator 170 is mounted to an outside of the truck frame 160. However, it should be appreciated that one or more of the components may be mounted within the truck frame 160. In some embodiment, a mounting plate 190 is coupled to the camshaft 176. The mounting plate 190 secures the components of the variable spring management system to the truck frame 160, for example, by any suitable fastening means, such as using bolts or by welding.

It should be noted that traction motors (not shown) in various embodiments, are not provided in connection with the center axle 118*b*, but are provided in connection with the outer axles 118*a* and 118*c* as described herein. It also should be appreciated that the truck frame 160 may be provided in any suitable manner to support and move a locomotive such that the variable spring preloading of various embodiments may be implemented in connection therewith.

Thus, various embodiments provide variable spring preloading of a locomotive suspension system. The variable spring preloading causes load redistribution among the axles of the locomotive. For example, dynamic weight transfer may be provided from a center axle to outer axles in a locomotive truck.

Figure 12:
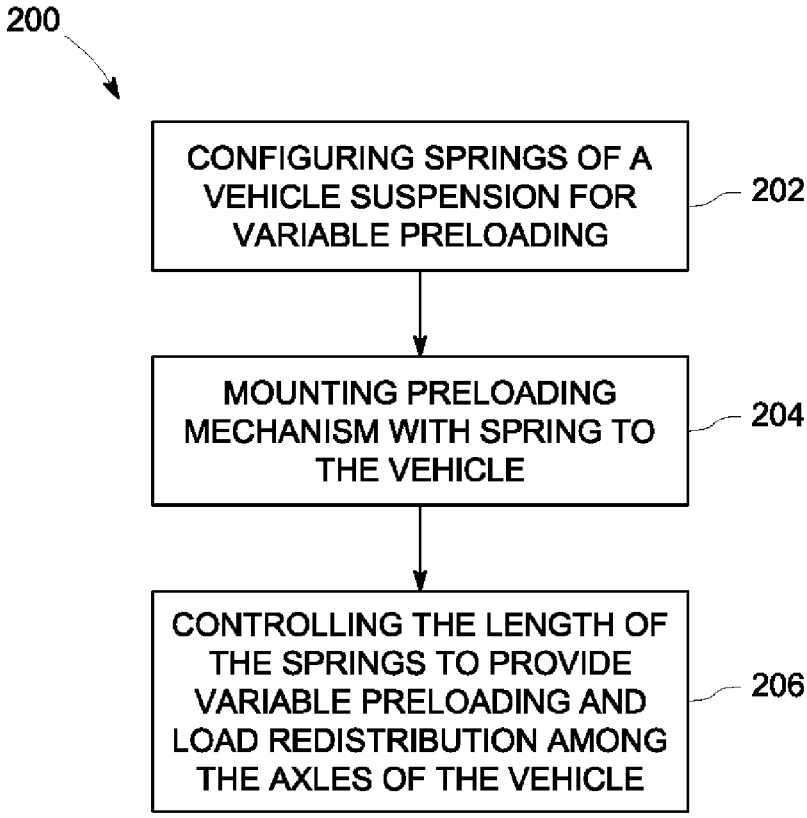
FIG. 12 is a flowchart of a method to dynamically redistribute weight in a vehicle in accordance with various embodiments.

A method 200 as shown in FIG. 12 also may be provided to dynamically redistribute weight in a vehicle. The method 200 includes configuring springs of a vehicle suspension for variable preloading at 202. For example, a mechanism for lengthening and shortening the springs, such as using a spring seat displacement with pneumatic actuation described herein allows for variable preloading of the springs based on a variable compression applied by the spring seat.

The method 200 then includes mounting the preloading mechanism to the vehicle at 204. For example, springs having the preloading mechanism may be mounted to the vehicle or a portion thereof, such as the axle box. In some embodiments, the preloading mechanism is provided on springs of an inner axle and not on the outer axles of a three axle truck, with two trucks provided per vehicle.

With the preloading mechanism mounted with the springs, the length of the springs is controlled at 206 to provide variable preloading and load/weight redistribution among the axles of the vehicle. For example, by varying the length of one or more of the springs, the preloading of the spring is changed, which redistributes the load among the axles of the vehicle. The controlling may be provided using a control module that dynamically adjusts the length of the springs using an actuator, for example, a pneumatic actuator. The changes to the preloading may be based on different factors, such as traction limited modes of operation.

Various embodiments may dynamically control preloading of springs in a vehicle. For example, variable spring preloading may be provided on the center axle suspension (spring) pocket on the two trucks in a vehicle. This varied preloading results in changing the overall load distribution on the three axles of the truck, leading to a distribution of the vehicle load to put more load on the powered outer axles. The higher load on the powered outer axles helps improve traction. In some embodiments, the redistribution of load, which reduces wheel slip, also increases braking. For example, the weight transfer prevents the wheels from slipping, thereby providing an anti-locking braking system for a vehicle. Such anti-locking braking system may be used, for example, at high speed operation and can reduce braking time.

In operation, and for example, the variable preloading redistributes the load on the three axles of a truck in a vehicle. The redistribution provides more load on the powered axles and may be used, for example, in locomotives that have six load carrying axles, but has traction motors on only four axles (the outer ones for each truck). The load redistribution enables more traction to be generated on the powered axles, such as during traction limited modes of operation for these locomotives. Thus, the locomotive may be driven with four traction motors.

The various embodiments may be implemented with no changes to the truck frame. For example, the motor and the variable spring preload mechanism can be mounted on the truck frame on either the inside or outside of the frame.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the above subject matter, including the best mode, and also to enable any person skilled in the art to practice the embodiments of subject matter, including making and using any devices or systems and performing any incorporated methods. The patentable scope of the subject matter described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A vehicle suspension system, comprising:

a plurality of springs;

a plurality of movable spring seats configured to adjust a length of the plurality of springs;

a pneumatic actuator connected to the plurality of movable springs and configured to move the movable spring seats to adjust the length of the plurality of springs; and a controller coupled to the pneumatic actuator to control the pneumatic actuator to adjust the length of the plurality of springs, wherein the plurality of springs comprise outer axle springs and inner axles springs, and wherein the plurality of moveable spring seats are coupled only to the inner axle springs.

2. The vehicle suspension system of claim 1, wherein the controller dynamically adjusts the length of the plurality of springs based on operating conditions.

3. The vehicle suspension system of claim 1, wherein the movable spring seats are positioned at one end of the plurality of springs with an opposite end of the plurality of springs being fixed.

4. The vehicle suspension system of claim 1, wherein the pneumatic actuator comprises a cam arrangement configured to convert rotational movement of a lever actuated by cylinders to translational movement of the plurality of spring seats to linearly adjust a length of the plurality of springs.

5. The vehicle suspension system of claim 1, further comprising an axle box and wherein one end of the plurality of springs engages the plurality of movable spring seats and an opposite end engages a vehicle frame in a non-movable configuration.

6. The vehicle suspension system of claim 1, wherein the plurality of movable spring seats are configured for vertical linear movement.

7. The vehicle suspension system of claim 1, wherein the plurality of movable spring seats comprise movable plates.

8. The vehicle suspension system of claim 1, wherein the pneumatic actuator comprises a lever configured to rotate a camshaft using a pair of cylinders pivotally connected to the lever, wherein rotation of the camshaft rotates a cam that translate the plurality of movable spring seats.

9. The vehicle suspension system of claim 8, wherein the plurality of movable spring seats comprises plates and further comprising a guide configured to maintain the plurality of movable spring seats along a linear path.

10. The vehicle suspension system of claim 8, further comprising a pair of stops connected to the lever and the cam to define a total amount of rotation of the cam.

11. The vehicle suspension system of claim 8, wherein the cam is configured to rotate about 90 degrees.

12. A vehicle system, comprising:

a frame configured to receive a plurality of axles, each of the axles having A corresponding spring suspension system with a plurality of springs;

a traction motor coupled to at least some of the plurality of axles;

a plurality of movable spring seats configured to adjust a length of the plurality of springs to change a preloading of the springs;

a pneumatic actuator connected to the plurality of movable springs and configured to move the movable spring seats to adjust the length of the plurality of springs; and a controller coupled to the pneumatic actuator to control the pneumatic actuator to adjust the length of the plurality of springs, wherein the traction motors are coupled only to outer axles and the pneumatic actuator is coupled to an outside of the frame in connection with a center axle.

13. The vehicle system of claim 12, wherein the controller dynamically adjusts the length of the plurality of springs based on operating conditions.

14. The vehicle system of claim 12, wherein the pneumatic actuator comprises a cam arrangement configured to translate rotational movement of a lever actuated by a pair of cylinders to linear movement of the plurality of movable spring seats.

15. The vehicle system of claim 14, further comprising a pair of stops connected to the lever and a cam of the cam arrangement to define a total amount of rotation of the cam.

16. The vehicle system of claim 12, wherein the pneumatic actuator comprises cylinders further configured to operate a braking operation.

17. A method for dynamically redistributing weight in a vehicle, the method comprising:

configuring a plurality of springs of a vehicle suspension system for variable preloading;

mounting a preloading mechanism with the plurality of springs to the vehicle, the preloading mechanism having a pneumatic actuator;

controlling a length of the plurality of springs to provide variable spring preloading and load redistribution among axles of the vehicle; and controlling the length of the springs in a center suspension connected to a center axle not having a traction motor and wherein outer suspensions connected to outer axles include traction motors.

18. The method of claim 17, further comprising controlling the spring length based on operating conditions using a control module.

19. A vehicle suspension system, comprising:

a plurality of springs;

a plurality of movable spring seats configured to adjust a length of the plurality of springs;

a pneumatic actuator connected to the plurality of movable springs and configured to move the movable spring seats to adjust the length of the plurality of springs; and a controller coupled to the pneumatic actuator to control the pneumatic actuator to adjust the length of the plurality of springs, wherein the pneumatic actuator comprises a lever configured to rotate a camshaft using a pair of cylinders pivotally connected to the lever, wherein rotation of the camshaft rotates a cam that translate the plurality of movable spring seats.

20. The vehicle suspension system of claim 19, wherein the plurality of movable spring seats comprises plates and further comprising a guide configured to maintain the plurality of movable spring seats along a linear path.

21. The vehicle suspension system of claim 19, further comprising a pair of stops connected to the lever and the cam to define a total amount of rotation of the cam.

22. The vehicle suspension system of claim 19, wherein the cam is configured to rotate about 90 degrees.

23. A vehicle system, comprising:

a frame configured to receive a plurality of axles, each of the axles having a corresponding spring suspension system with a plurality of springs;

a traction motor coupled to at least some of the plurality of axles;

a plurality of movable spring seats configured to adjust a length of the plurality of springs to change a preloading of the springs;

a pneumatic actuator connected to the plurality of movable springs and configured to move the movable spring seats to adjust the length of the plurality of springs; and a controller coupled to the pneumatic actuator to control the pneumatic actuator to adjust the length of the plurality of springs, wherein the pneumatic actuator comprises a cam arrangement configured to translate rotational movement of a lever actuated by a pair of cylinders to linear movement of the plurality of movable spring seats.

24. The vehicle system of claim 23, further comprising a pair of stops connected to the lever and a cam of the cam arrangement to define a total amount of rotation of the cam.

* * * * *